United States Patent [19]

Mumford

[11] 4,322,009

[45] Mar. 30, 1982

[54] TAMPER PROOF MOLDED PLASTIC CLOSURE

[75] Inventor: George V. Mumford, Toledo, Ohio

[73] Assignee: Owens-Illinois, Inc., Toledo, Ohio

[21] Appl. No.: 151,046

[22] Filed: May 19, 1980

[51] Int. Cl.[3] ..... B65D 41/32

[52] U.S. Cl. ..... 215/253

[58] Field of Search ..... 215/252, 258, 344, 253, 215/DIG. 1; 220/266; 113/121A; 53/485, 490

[56] References Cited

U.S. PATENT DOCUMENTS

| | | | |
|---|---|---|---|
| 3,001,657 | 9/1961 | Gamble | 215/252 |
| 3,329,295 | 7/1967 | Fields | 215/252 |
| 3,601,273 | 8/1971 | Kutcher | 215/252 |
| 3,746,202 | 7/1973 | Moller | 215/252 |
| 3,796,338 | 3/1974 | Wilton | 215/252 |
| 3,920,503 | 11/1975 | Keeler | 215/258 X |
| 4,147,268 | 4/1979 | Patel et al. | 215/258 |
| 4,196,818 | 4/1980 | Brownbill | 215/252 |

*Primary Examiner*—George T. Hall
*Attorney, Agent, or Firm*—John R. Nelson; Myron E. Click; David H. Wilson

[57] ABSTRACT

A tamper proof molded closure is provided for use on a threaded bottle neck having an external peripheral bead below the threaded portion of the bottle neck. The closure comprises a one piece molded cap having a circular panel portion and a depending annular skirt portion with the upper portion of the skirt defining internal threads and a lower band portion of the skirt defining an internal shoulder that is expandable to snap over the container bead during the assembly operation to lock the closure to the bottle neck. At a region intermediate the threaded portion and the interior shoulder, the external wall of the band portion of the closure is scored to form a slit extending peripherally around the entire closure. The depth of the slit extends through the wall of a closure at all points except for a limited number of peripherally spaced arcuate segments where the depth of the slit is less than that of the thickness of the skirt portion. This provides connecting bridges between the threaded portion and the band portion of the closure which are readily severable by rotational movement of the closure in a direction to unscrew it from the bottle neck. The slit height is limited to permit collapsing of the slit during the application of the closure to force the internal shoulder over the container bead.

6 Claims, 10 Drawing Figures

TAMPER PROOF MOLDED PLASTIC CLOSURE

BACKGROUND OF THE INVENTION

Tamper proof closures have been widely utilized by packers of food, beverage and liquor items in recent years to provide an indication to the final purchaser as to whether the closure provided on the package, has been previously removed. A cloure that is applied by threaded engagement with the container neck is particularly susceptible to tampering. Any person passing through a super market could quickly pick up such a container, remove the closure, sample a portion of the contents and then replace the closure. The tampering problem is common to foods, soft drinks, and liquors. Generally, the more expensive the product, the more likely is the possibility that the container will be subjected to tampering.

Insofar as narrow neck containers are concerned, an aluminum shell type closure has been utilized heretofore to provide a tamper proof feature. Such shell is formed with a generally cylindrical skirt portion which is then subjected to a cutting operation to cut a series of peripherally extending slots in a medial portion of the skirt sidewall. The skirt sidewall is then applied to the container neck in conventional fashion by roll forming the threads in the closure sidewall and concurrently deforming the extreme bottom portion of the panel to engage underneath a peripherally extending external rib on the bottle neck to lock the bottom panel portion to the container. Any subsequent attempt to remove the closure by unscrewing it from the container neck results in the severance of the bridges which constitute the uncut portions of the panel skirt remaining after the aforementioned cutting operation.

Attempts have heretofore been made to provide the same type of construction in a molded plastic closure. All of such prior art attempts have been in the direction of producing the molded slots and bridges in the closure during the original closure molding operation on the theory that forming the complete closure in one operation was the less expensive route to follow. This has not proven to be the case, however. To incorporate the annular series of slots interspaced by bridges in the molded closure, a complex mold has to be provided, thus greatly increasing the mold costs for producing such closures. Furthermore, due to variations that are inherent in the closure molding process when an attempt is made to form very small segments of plastic interconnecting larger segments, the size and strength of the resulting bridges varied substantially, thus, providing noticeable variations in the shearing strength of the bridges thus produced. Lastly, if conventional applicating machines were to be used, the bridges had to be sufficiently large to not sever when forcing the retaining rib over the container neck bead during application of the closure.

SUMMARY OF THE INVENTION

A tamper proof molded plastic closure is fabricated in accordance with this invention by first molding a simple closure having a circular cap and a depending, substantially uniform thickness sidewall. The upper sidewall defines internal threads to cooperate with the threaded portion of a bottle neck while the lower portion defines a retaining band. The retaining band defines an internal rib adapted to expand under axial force to snap over the neck bead conventionally provided on the neck of the bottle below the bottle threads. A peripherally extending, narrow width slit is then cut into the skirt portion of the closure by an externally applied knife at a point above said internal shoulder. The radial depth of the slit cut into the closure wall is equal to the wall thickness of the skirt portion, and extends entirely through the wall, except at a number of peripherally spaced locations where a limited arcuate segment of said slit is cut to a lesser depth than said wall thickness, thus, defining a plurality of limited areas of bridge connections between the upper threaded portions of the closure skirt and the lower band portion. Such bridge connections are of uniform dimensions and are readily severable by a predetermined torque applied to the closure in a direction to unscrew it from the bottle neck. The slit is sufficiently narrow to have the opposed wall portions thereof abut under the axial force required to snap the closure rib over the neck bead, thus minimizing the possibility of severing the bridges during closure application.

Further objects and advantages of the invention will be apparent to those skilled in the art from the following detailed description, taken in conjunction with the annexed sheets of drawings on which is shown a preferred embodiment of the invention.

DESCRIPTION OF THE PREFERRED EMBODIMENTS

Figure 1:
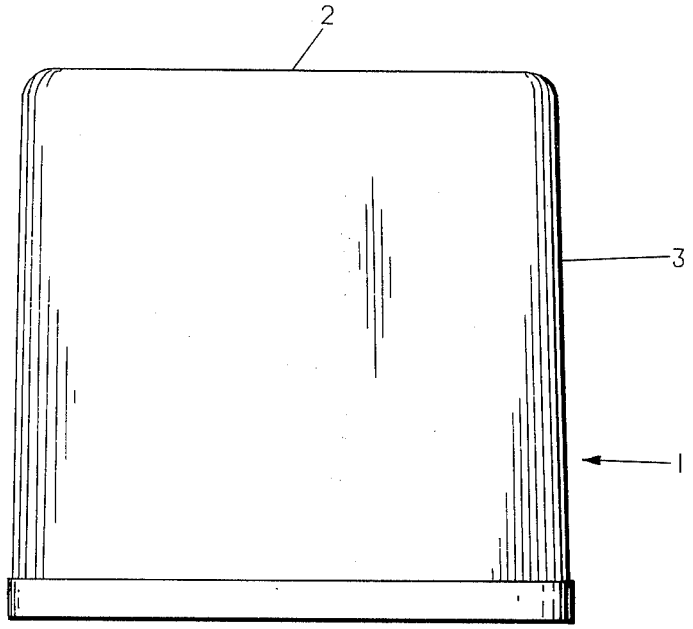
FIG. 1 is a side elevational view of a closure as it is produced in the molding operation.
Figure 2:
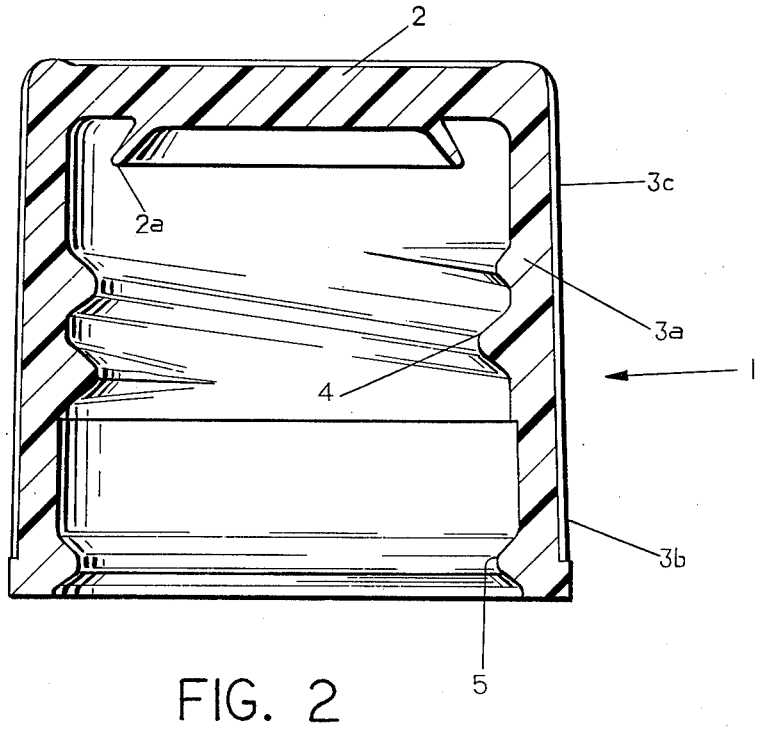
FIG. 2 is a vertical sectional view of the closure of FIG. 1.

Referring to FIGS. 1 and 2, the fabrication of a tamper proof closure embodying this invention is initiated by a molding of a very simple closure shape illustrated in FIGS. 1 and 2. The initial molding comprises an inverted cup shaped element 1 having a circular panel portion 2 with an integral depending skirt portion 3. Skirt portion 3 may have vertical serrations 3*c*. The upper portion 3*a* of skirt 3 defines internally projecting threads 4 which are configured to cooperate with external threads provided on the neck of the container or bottle to which the closure is to be applied. The lower portion 3*b* of the closure skirt 3 defines an inwardly projecting peripheral rib or shoulder 5. Rib 5 is dimensioned to snap over the peripherally extending rib conventionally provided on the neck of the bottle and represented by the numeral 12 in FIG. 7.

It will be apparent to those skilled in the art that the simple shape of closure 1 heretofore described will permit the high speed, economical production of such closures by conventional injection molding process. The sealing element of the closure with respect to the bottle neck forms no part of this invention, and may comprise either an inserted liner, or an integral downwardly projecting annular rib 2*a* (FIGS. 2 and 7) which cooperates in sealing relationship with the top surface of the bottle neck 10. Polypropylene is a preferred material, but any other plastic having similar tensile and resilient properties may be utilized.

Figure 3:
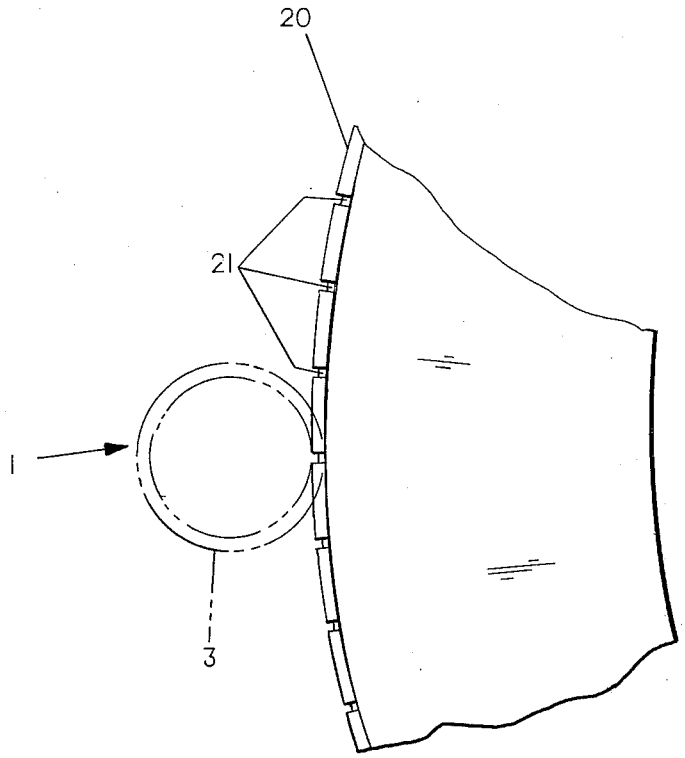
FIG. 3 is a schematic plan view of the slitting knife applied to the skirt of the closure.
Figure 4:
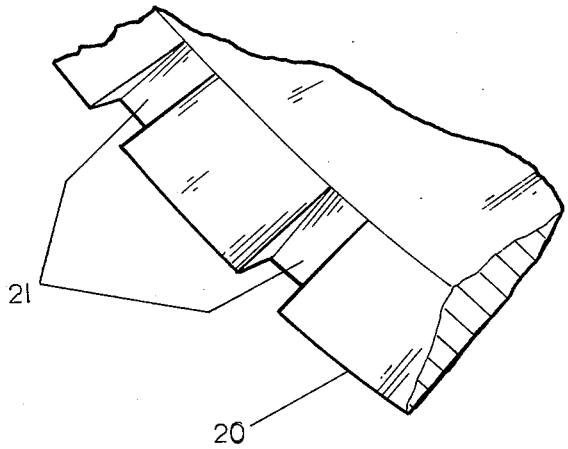
FIG. 4 is an enlarged scale perspective view of a portion of the slitting knife.

The next operation in producing the closure embodying this invention is to cut an external slit 6 in the lower portions of the skirt 3. Referring to FIG. 3, such slitting operation may be accomplished by rotating the closure skirt 3 along a knife edge 20 having spaced notches 21 cut therein. The engagement of the closure skirt 3 with the knife 20 is such that the knife 20 normally penetrates the entire depth of the closure skirt wall, except at the locations of the knife edge notches 21, where a bridge 7 of material will be left uncut. This slitting operation may be performed on existing machines utilized for cutting peripheral notches in aluminum cap shells.

Figure 5:
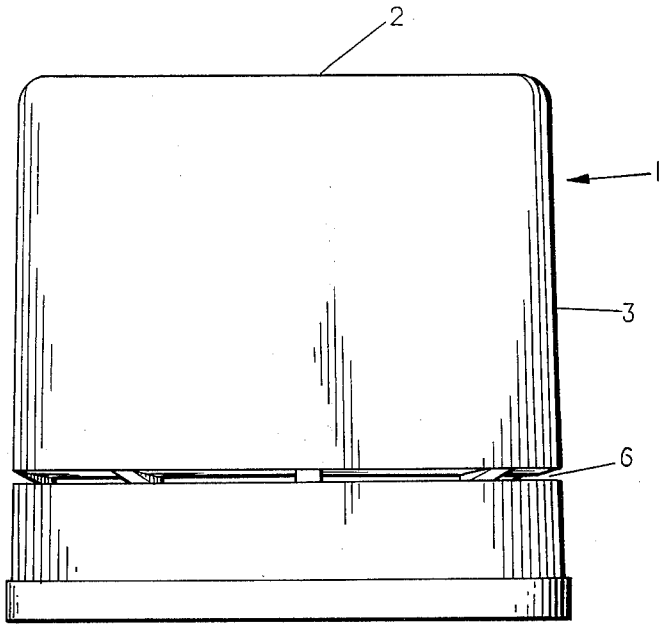
FIG. 5 is a side elevational view of the finished slit closure embodying this invention.
Figure 6:
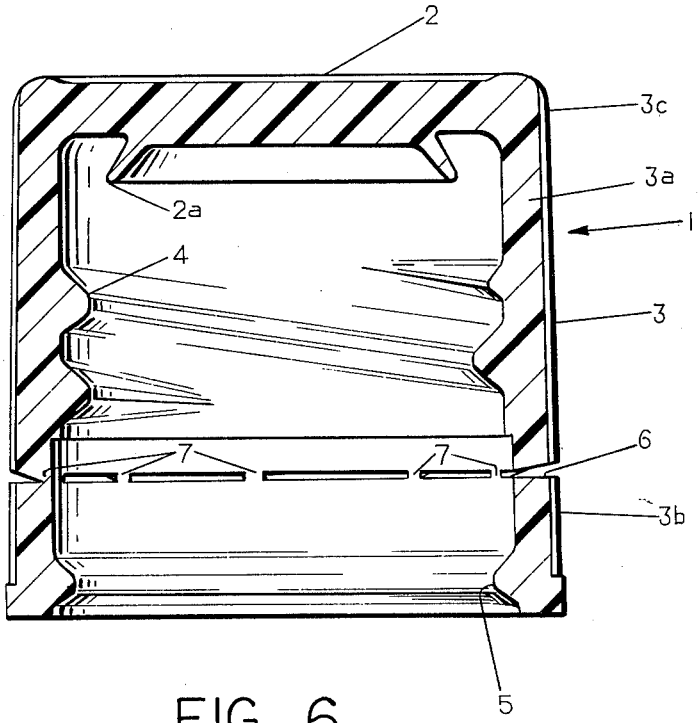
FIG. 6 is a vertical sectional view of the closure of FIG. 5.
Figure 7:
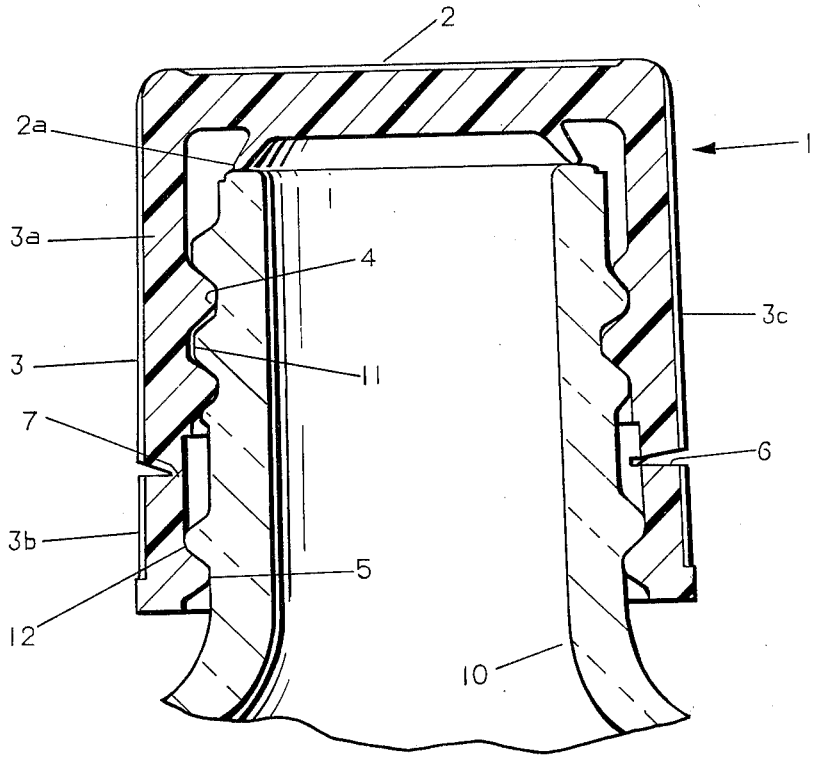
FIG. 7 is a vertical sectional view of the closure of FIG. 5 in assembled relation to a threaded bottle neck.

This operation results in the final form of the closure embodying this invention illustrated in FIGS. 5 and 6, wherein the same reference numerals indicate the same parts heretofore described. It will be seen that a slit 6 has now been cut in the wall of the skirt portion 3 intermediate the threaded portion 3*a* and the locking shoulder 5. The slit 6 extends entirely through the wall of the closure skirt 3 except at a plurality of peripherally spaced locations where a thin bridge of material 7 is left, corresponding to the location of the notches 21 provided in the cutting knife 20. It will be noted that the bridges 7 extend radially outwardly from the inner wall surface of the skirt 3 to the outer surface of the skirt 3. The bridges are, therefore, entirely protected from abuse during handling and conveying prior to assembling the closure on a threaded bottle neck 10 as indicated in FIG. 7.

Figure 8:
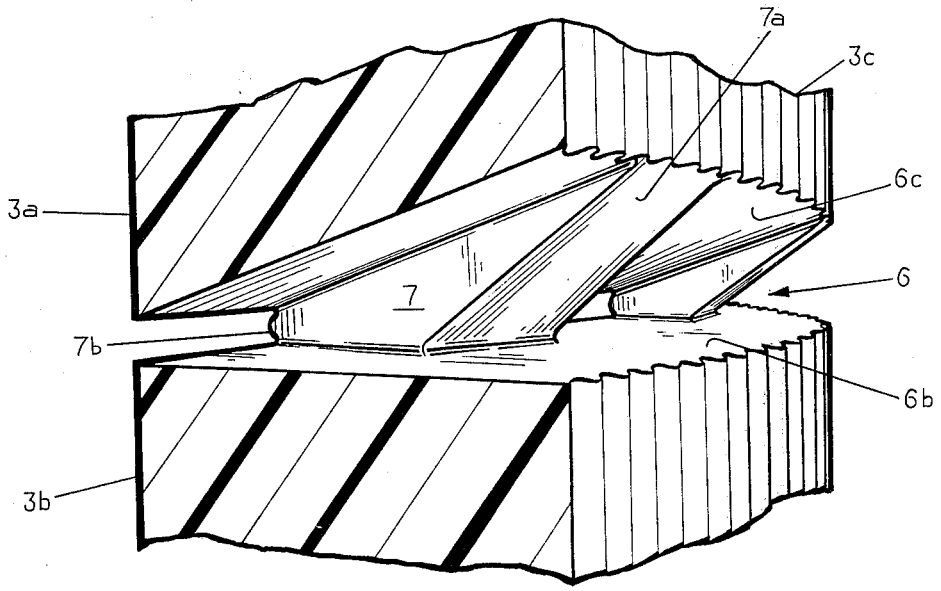
FIG. 8 is an enlarged scale perspective view of the slit portion of the closure of FIG. 5.

In the preferred embodiment of this invention, illustrated in enlarged scale in FIG. 8, each slit 6 is cut with a tapered cross-section, preferably with the top wall tapered upwardly, to provide relief for the cutting knife 20. Each bridge 7 is then cut so that the outwardly facing surface 7*a* thereof is inclined upwardly and outwardly. This means that the lower area of the bridge 7 will be substantially reduced in size relative to the upper area of the bridge. The reduced lower area means that the severing of the bridges 7 may be more readily accomplished, while the inclined surface 7*a* facilitates the abutting of the intermediate portions of the horizontal wall surface 6*b* and inclined wall surface 6*c* of slit 6 when sufficient axial force is applied to the closure during application to snap the internal locking shoulder 5 of the closure over the retaining bead 12 of the container neck, as will be described more in detail hereinafter.

The slitting operation will provide a slight inward deformation 7*b* of the inner wall of the bridge 7.

As the closure 1 is rotatingly applied to the threaded bottle neck 10, any conventional applicating machine concurrently applies a downward force to the closure. The combination of this force with the inherent force produced by the cooperation of the closure threads 4 with the bottle neck threads 11 forces the internally projecting retaining shoulder 5 of the closure to expand over the retaining ring 12 provided on the bottle neck 10. This action occurs just prior to the full seating of the threads of the closure on the threads of the bottle neck 10.

Any attempt to remove the closure by applying a rotational torque to the closure in a direction to loosen the closure from the threaded bottle neck will effect the severance of the bridges 7 and thus provide a positive indication that the closure has been tampered with.

Those skilled in the art will recognize that the extreme thinness of the slit 6 provided in the closure wall provides assurance that the bridges 7 may be made quite small in cross-section without impairing the transmission of axial force to lower skirt portion 3*b*, inasmuch as the inherent resilience of the plastic material of skirt portion 3*b* will bring portions of the opposed walls 6*b* and 6*c* of the slits 6 into abutting engagement when the closure is being assembled and, hence, the entire axial force of expanding the retaining rib 5 of the closure over the locking bead 11 of the bottle neck 10, while at the same time rotating the closure portion containing the rib 5, does not have to be borne by the bridges 7. As a result, the bridges 7 may be made quite small and hence readily severable when an attempt is made to remove the closure from the bottle by counter clockwise rotation thereof in conventional fashion.

Preferably a slit having a maximum height on the order of 0.005 to 0.030 inches is employed. The cross-sectional area of the small area portion of bridges 7 is on the order of 0.0013 sq. in. The number of bridges increases with the diameter of the closure 1. From 6 to 10 bridges are preferred for a 28 mm. liquor cap.

Figure 9:
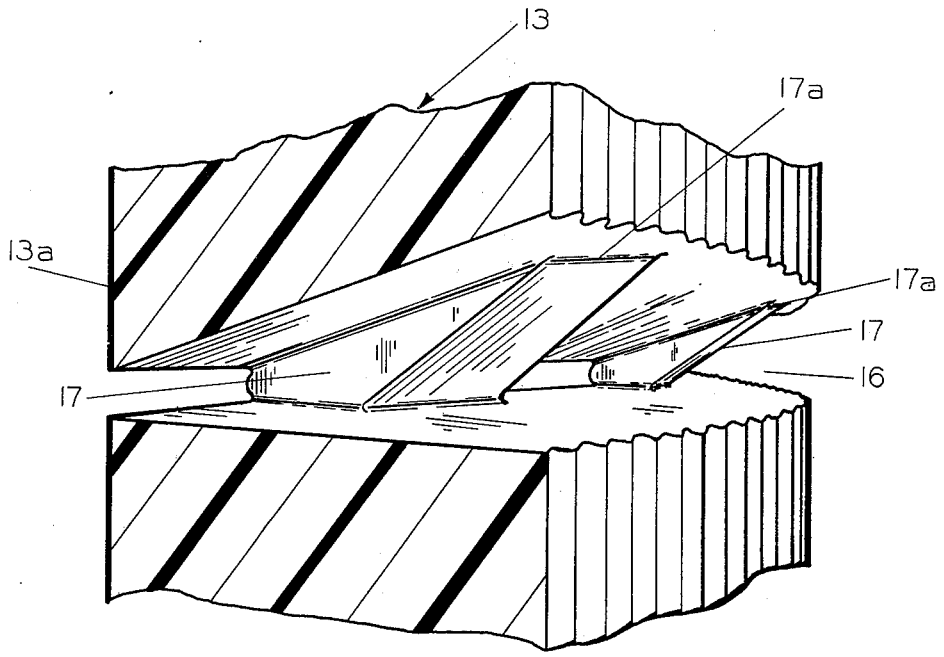
FIG. 9 is a view similar to FIG. 8 but illustrating an alternate configuration of the bridges in the slit portion.

If the invention is to be applied to a cap having a relatively thick skirt portion, then the bridge configuration shown in FIG. 9 may be employed. The slit 16 extends entirely thru the side wall 13 of the closure but the bridges 17 extend radially from the inner wall 13*a* of such side wall to a medial portion of the slit 16, terminating radially within the outer extremity of side wall 13. This construction again permits portions of the slit walls 16*a* and 17*a* to abut when axial pressure is applied to the cap to force the retaining shoulder over the container bead 12.

Figure 10:
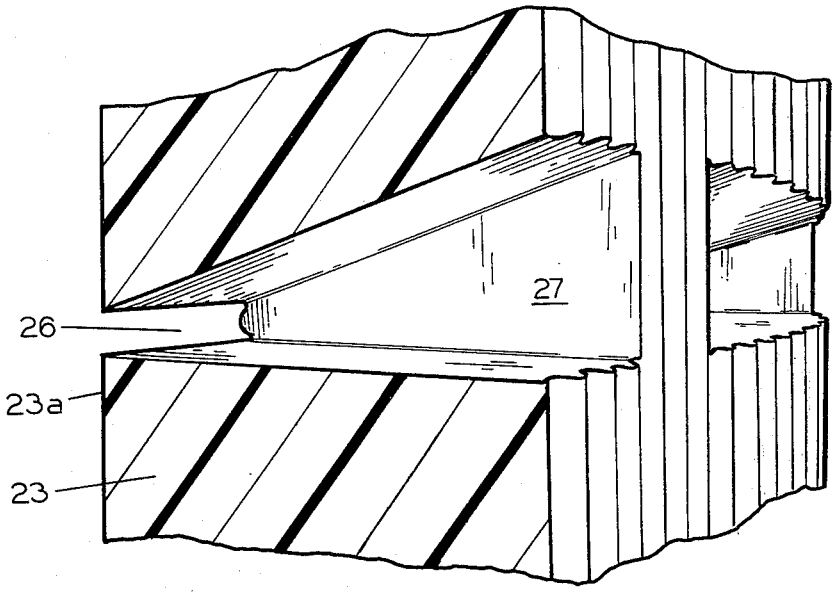
FIG. 10 is a view similar to FIG. 8 but illustrating still another configuration of the bridges.

If the invention is to be applied to a cap having a relatively thin skirt portion, then the bridge configuration shown in FIG. 10 may be employed. The slit 26 again extends entirely through the side wall 23 of the closure but the bridges 27 extend radially from the inner wall 23*a* of such side wall to the outer extremity of side wall 23. Moreover, the bridges 27 are not of truncated configuration but occupy the entire space between the opposed walls of the slit 26. This construction still permits the intermediate portions of the slit 26 to abut when axial pressure is applied to the cap during application to the container to force the retaining shoulder over the container bead 12.

Modifications of this invention will be readily apparent to those skilled in the art and it is intended that the scope of the invention be determined solely by the appended claims.

What is claimed is :

1. A tamper proof plastic closure for use on a threaded bottle neck having an external peripheral bead below the threaded portion comprising a one-piece molded cap having a circular panel portion and a depending annular skirt portion, said skirt portion having an upper internally threaded portion to cooperate with the bottle neck threaded portion and a lower band portion defining an internal shoulder expandable to snap over the container bead to lock the closure to the bottle neck, and a peripherally extending slit cut into said skirt portion above said internal shoulder by an externally applied knife, the radial depth of said slit being equal to the wall thickness of said skirt portion except at a number of peripherally spaced locations where a limited arcuate segment of said groove is of less depth than said wall thickness, thereby defining limited area bridge connections between said upper portion of the skirt and said lower band portion, said bridge connections being severable by rotational movement of said upper portion in a direction to unscrew the closure from the bottle neck.

2. The tamper proof closure of claim 1 wherein the vertical height of said slit and the areas of said bridge connections are proportioned to permit portions of the walls of said slit to abut under the axial force required to snap said shoulder over the container bead.

3. The tamper proof closure of claim 2 wherein the top and bottom walls of said slit are angularly disposed with the maximum spacing at the outer surface of the skirt portion.

4. The tamper proof closure in accordance with claim 1, 2 or 3 wherein the lower portion of each bridge connection is of smaller area than the upper portion and the outwardly facing wall of each bridge connection is upwardly and outwardly inclined.

5. The tamper proof closure of claim 1, 2 or 3 wherein the radial outer extermity of each bridge connection terminates within the periphery of said skirt portion.

6. The tamper proof closure of claim 1, 2, or 3 wherein each said bridges fills all of the space between the lower and upper walls of said slit.

* * * * *